United States Patent [19]

Greenway

[11] Patent Number: 4,747,468

[45] Date of Patent: May 31, 1988

[54] FALL ARREST DEVICE

[76] Inventor: William E. Greenway, #3 Kilpatrick Drive, Holland Landing, Ontario, Canada, L0G 1G0

[21] Appl. No.: 94,762

[22] Filed: Sep. 10, 1987

[30] Foreign Application Priority Data

Sep. 10, 1986 [CA] Canada ..... 517,893

[51] Int. Cl.[4] ..... A62B 35/00

[52] U.S. Cl. ..... 182/9; 182/133

[58] Field of Search ..... 182/9, 133–135, 182/206, 221, 3, 8

[56] References Cited

U.S. PATENT DOCUMENTS

| | | | |
|---|---|---|---|
| 2,842,300 | 7/1958 | Johnson | 182/133 |
| 2,879,830 | 3/1959 | Johnson | 182/9 |
| 2,920,714 | 1/1960 | Johnson | 182/9 |
| 4,407,391 | 10/1983 | Greenway | 182/9 |
| 4,595,078 | 6/1986 | Greenway | 182/9 |

*Primary Examiner*—Reinaldo P. Machado
*Attorney, Agent, or Firm*—Rogers & Scott

[57] ABSTRACT

The invention provides a fall arrest device for pole climbers consisting of a yoke for engagement with a pole on the side opposite the climber and two arms attached to respective ends of the yoke. Each arm carries a rotatable engagement structure and strap attachment means so that tension in an associated strap, to connect the climber's waist belt to the device, will bring the arms towards one another and the engagement structures will be forced against the pole to hold the device in position to support the climber. Also, the invention provides a fall arrest device having safety elements passing through the device between the strap attachments so that if the device breaks the safety elements continue to provide a mechanical link around the pole.

11 Claims, 5 Drawing Sheets

FALL ARREST DEVICE

This invention relates to a fall arrest device for pole climbers and more particularly to a device which permits greater flexibility for the user to permit movement around a pole as well as up and down the pole.

Pole climbers normally wear leg gaffs strapped one to each leg to engage the pole and support the climber on the pole. In conjunction with these gaffs the climber uses some form of strap which can be looped around the pole and attached to the climber's waist belt. The strap is used principally for supporting the climber as he works but can also be used to assist climbing. This is done by throwing the strap up the pole and using the tension in the strap as an aid to climbing the pole.

In the event that the gaffs slip or for some reason become disengaged from the pole, the climber is dependant on the strap, at least temporarily, to prevent a fall. Clearly, if the strap slips, there is a possibility that the climber will fall down the pole, which may result in injury.

Among the design criteria which would be satisfied by an ideal fall arrest device would be lightness, simplicity and a fail safe feature which would support the climber should the climber slip or become incapacitated in any way. Also, the device should be moveable to different heights and diameters on the pole without interfering significantly with its effectiveness, and it should be structured in such a way that there is minimal likelihood of total mechanical failure.

A number of fall arrest devices have been proposed. One example is to be found in U.S. Pat. No. 213,715 to Mengden who discloses pole climbing apparatus which requires two frames, one for use by the hand and the other by the feet. The hand operated frame encompasses the pole and is adjustable to accommodate poles of different diameters by means of pins which can be passed through registration openings in pairs of frame members at the front and at the rear of the device. There are a number of significant disadvantages including the fact that the device is complex to adjust and requires that the climber always applies weight to the members.

Another example is found in U.S. Pat. No. 869,382 to Newton who discloses a climber's fall arrest device which has an adjustable belt looped around the climber and the pole. The belt includes a curved plate with spurs for engaging the pole and an arm for moving the spurs between a pole engaging and a pole non-engaging position. In the event of slippage, the spurs are insufficient to retard the fall of the climber. Climbing the pole is very awkward with such a device.

Other examples of climbing devices are found in U.S. Pat. Nos. 2,842,300 to Johnson, 2,879,830 to Rayner, and 2,920,714 to Johnson which all disclose pole climbing aids encircling the pole and having teeth for engaging the pole. None of these devices is resiliently biased and adjustment is difficult. In the event of slippage, none of the devices would retard the climber's fall because they do not automatically close on the pole.

U.S. Pat. No. 4,407,391 to Greenway et al discloses a pole climber's safety device having a closed yoke for encompassing a pole. The yoke consists of two half yokes hingedly interconnected together and secured by a releasable fastening. Pole engaging blades are pivotally mounted on the underside of the yoke and in use, the blades are normally biased by weight or by springs to a pole engaging position. In practice it has been found that this device is difficult and time-consuming to adjust because first the pole blades have to be retained and held whilst the yoke is moved. The fixed, closed yoke limits the size of poles it can be used with, and indeed with some poles, the climber could not climb to the top because the blades do not engage adequately the narrower, upper part of the pole.

More recently, U.S. Pat. No. 4,595,078 to the present applicant issued and describes a fall arrest device for a pole climber which has a main yoke with resiliently biased arms at each end for partly encompassing a pole. The resiliently biased arms are moveable in the same plane as the main yoke and accommodate a range of pole diameters. Handles are attached to each arm for gripping by a pole climber to move the arms so that the fall arrest device can be raised or lowered. Also, each arm has eyelets for receiving safety straps attached to the pole climber so that a pull on the strap due possibly to the pole climber slipping, causes the arms to move towards each other and to grip the pole. This fail-safe structure has great advantages over the prior art. However, the present inventive improvements are designed to enhance the structure even further.

One of the disadvantages of the structure in U.S. Pat. No. 4,595,078 is the fact it is difficult to move around the pole so that the climber is forced to use significant effort to change his position around a pole at a particular level. Also, the structure tends to be rather heavy to use and this can be tiring for the climber. Accordingly, it is an object of the present invention to provide a fail-safe structure of the type described in U.S. Pat. No. 4,595,078 and which is light in use, fail-safe and allows the climber to move around the pole easily and without great effort at any height.

In one of its aspects the invention provides a fall arrest device consisting of a yoke and two arms attached to respective ends of the yoke. Each arm carries a rotatable engagement structure and strap attachment means so that tension in an associated strap will bring the arms towards one another and the engagement structures will be forced against the pole to hold the device in position to support the climber.

In another of its aspects, the invention provides a fall arrest device having safety elements passing through the device between strap attachments so that if the device breaks the safety elements continue to provide a mechanical link around the pole.

These and other aspects of the invention will be better understood with reference to the drawings in which.

Figure 1:
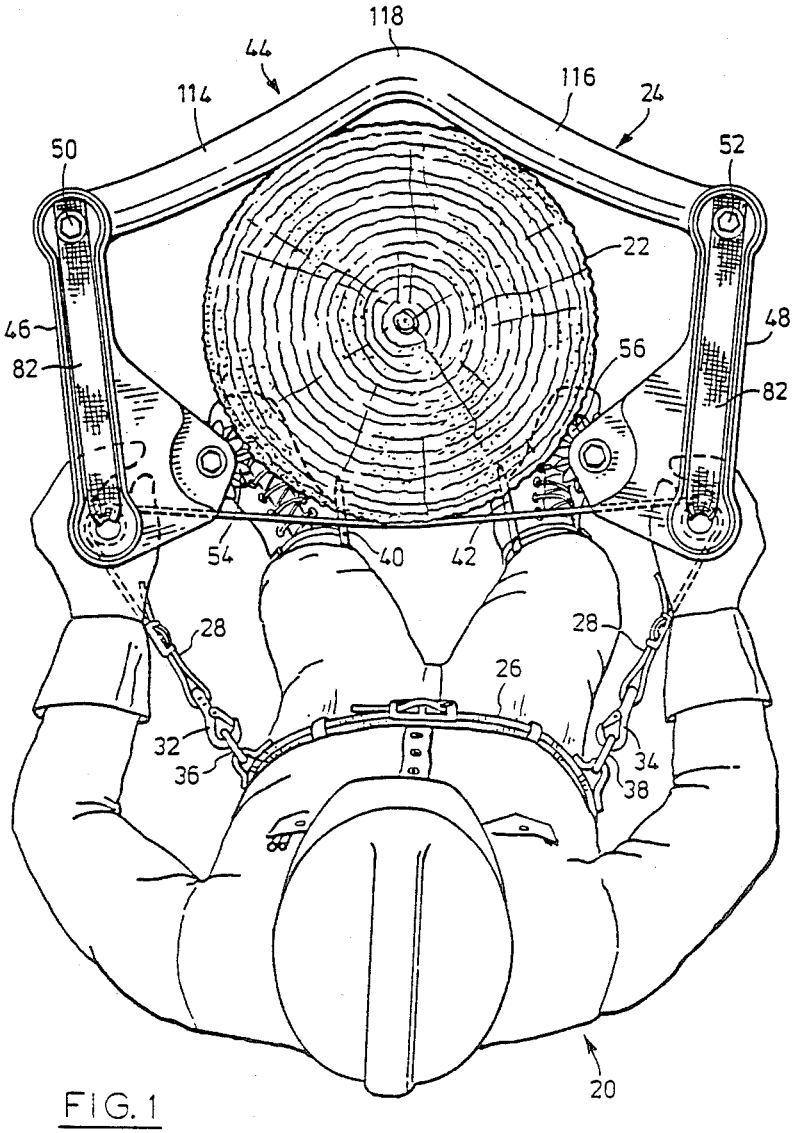
FIG. 1 is a diagrammatic top view of a pole climber using a preferred form of fall arrest device having a yoke and a pair of arms.

Reference is made first to FIG. 1 of the drawings which illustrates a climber 20 working on a pole 22 which could be a telephone pole or any other utilities pole. The climber is using a preferred embodiment of fall arrest device 24 according to the present invention and is secured to the fall arrest device by a body belt 26 connected via an adjustable strap 28 having respective snap fittings 32, 34 used to attach the belt to rings 36, 38 on the belt 26.

As is conventional, the climber uses a pair of leg gaffs 40, 42 in combination with the fall arrest device to support himself on the pole. As will be described more fully with reference to subsequent drawings, the fall arrest device 24 consists of a yoke 44 being generally V-shaped in plan view and connected at its ends to a pair of allochiral arms 46, 48 by pivot joints 50, 52. The arms are biased at the pivot joints towards the pole 22 and the arrangement is such that any force applied to the strap 28 by the climber leaning backwards or falling will result in turning moments about the pivots 50, 52 bringing rotatable gaffs 54, 56 into firmer engagement with the pole to prevent the device sliding down the pole.

The yoke 44 and arms 46, 48 are of moulded synthetic plastics material, preferably a thermoplastic having good resistance to impact at lower temperatures. A material now found to be preferable is sold under the trade mark ZYTEL by E. I. DuPont although another material sold under the trade mark XENOY by General Electric Co. has also been used.

Before describing this structure in detail, the use of the structure will be described in order to better understand the details. When the climber wishes to move vertically, he applies outward forces to the arms while leaning towards the pole to release the load on the device. This brings the rotatable gaffs 54, 56 out of contact with the pole and allows the climber to lift the device up the pole to take a new position. He then adjusts his leg gaffs and continues with these movements to climb the pole. Clearly as the pole diameter changes, then the device will take up these changes and continue to support the climber. In the event that the climber wishes to move around the pole at a particular elevation, this can be done with the present device due to the use of the rotatable gaffs 54, 56. The climber biases himself either to the left or to the right and pushes the device in that direction. The yoke 44 exhibits a smooth surface in contact with the pole so that it will slide on the pole and the gaffs 54, 56 will rotate permitting the climber to adjust the leg gaffs 40, 42 around the pole, resulting in the climber moving to the left or to the right as he chooses at a particular elevation. Also, in situations such as that shown in FIG. 1, the strap 28 will touch the pole but exhibits little resistance to sliding because as the climber slides he releases some load in the strap.

Figure 2:
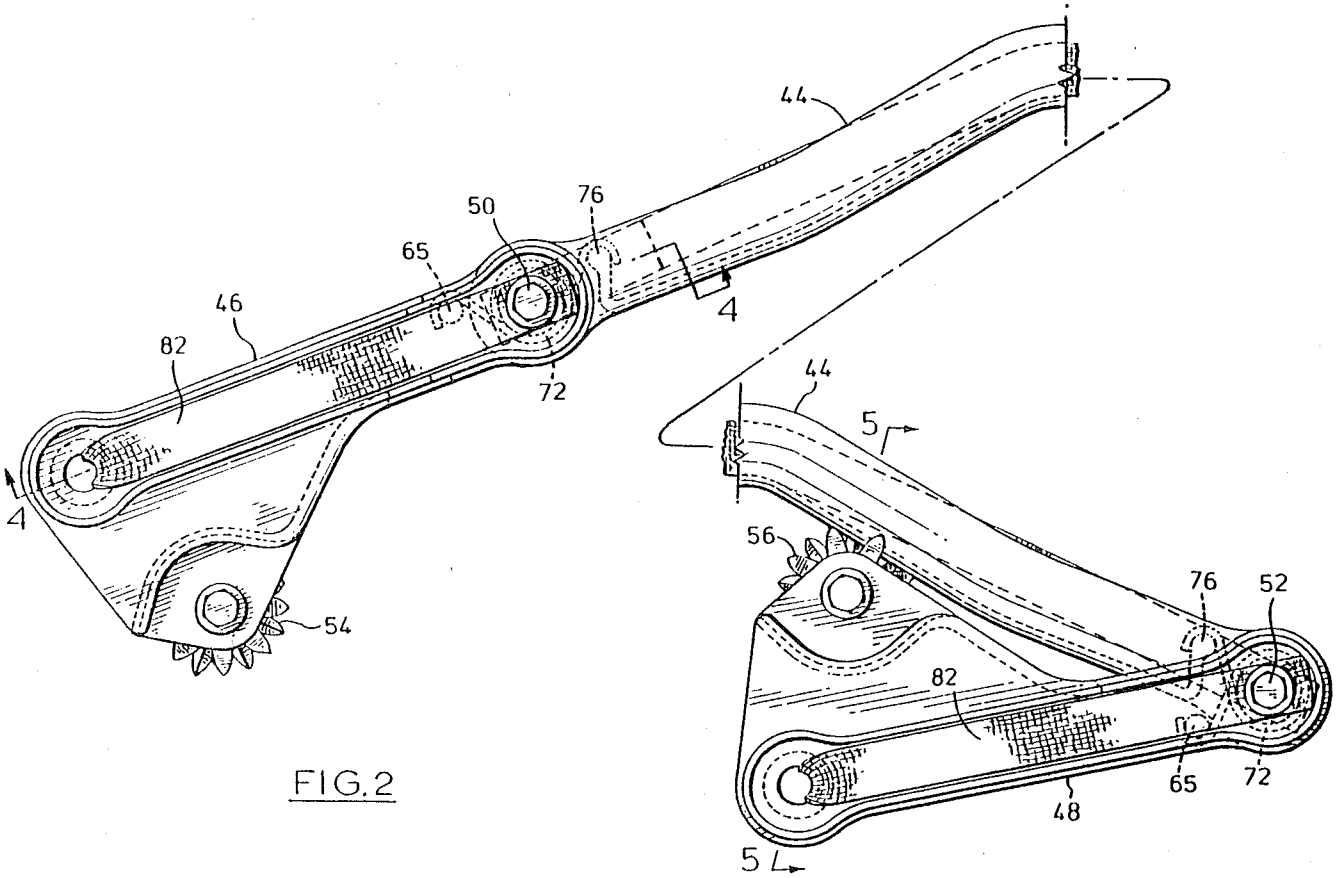
FIG. 2 is a top view of the device with one arm in a maximum open position and the other arm in a storage position.

Reference is next made to FIG. 2 which further illustrates the pole arrest device described with reference to FIG. 1. It will be seen in FIG. 2 that the arm 46 is in a fully extended position with reference to the yoke 44 whereas the arm 48 is in a stored position where the gaff 56 is cradled on the yoke 44. This storage position is the natural position of the device due to the spring biasing at the respective pivots 50, 52.

Figure 3:
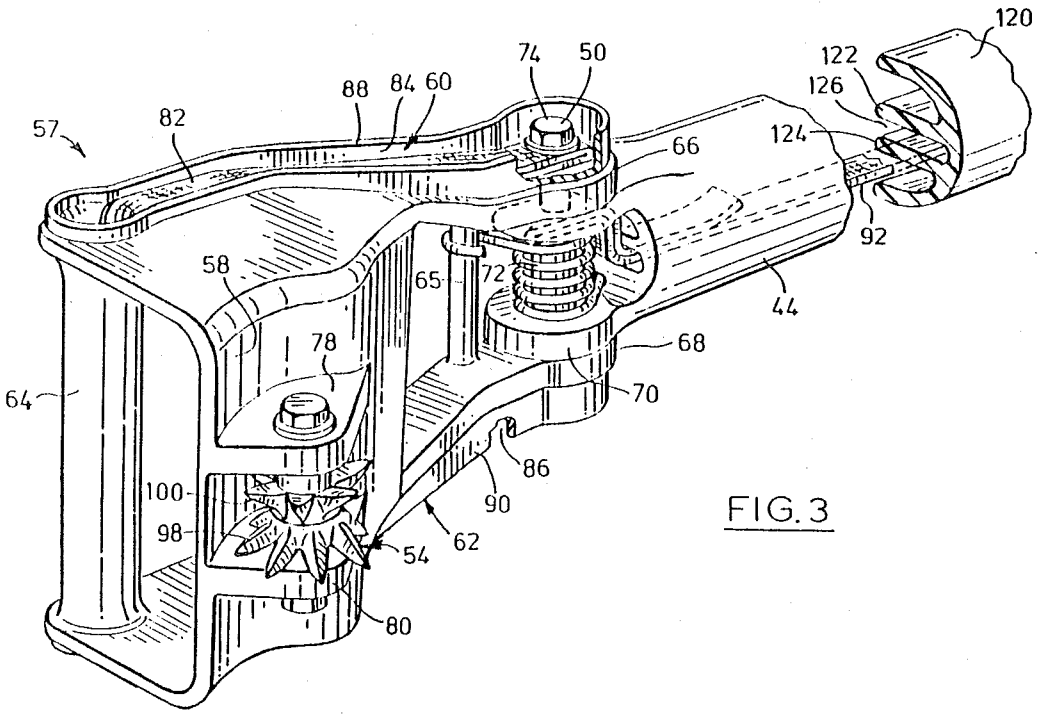
FIG. 3 is a perspective view drawn to a larger scale of one of the arms and including part of the yoke.

Next reference is made to FIG. 3 to describe some of the features of the end of arm 46, designated generally by reference numeral 57, which of course are typical also of the arm 48. A wall 58 is inwardly facing, (i.e. towards the pole in use) and extending axially with respect to the pivot joint 50. The wall terminates at a pair of allochiral side pieces designated generally by the numerals 60 and 62 which are also connected to one another by a hollow post 64 positioned outwardly from and spaced from the wall 58 and by a bar 65 adjacent the pivot joint 50. The side pieces 60, 62 converge slightly towards the pivot joint 50 to define a pair of respective spaced bosses 66, 68 between which is located a forked end 70 of the yoke 44. The forked end 70 provides space for a torsion spring 72 located about a fitted bolt 74 and anchored at one end to the bar 65 and at the other end to an integral web 76 seen in FIG. 4. Before describing the pivot joint in more detail, the remainder of the arm end 57 will be described with reference to FIG. 3.

The wall 58 carries a pair of parallel inwardly extending ribs 78, 80 supporting the wheeled gaff 54. Details of this arrangement will be described more fully with reference to FIG. 5. The hollow post 64 is for gripping by the user as shown in FIG. 1 and also to receive the strap 28. As better seen in FIG. 4, the hollow post 64 accommodates a safety element 82 in the form of a strip of webbing, preferably of woven NYLON (registered trade mark) such as that used in automobile safety belts and which extends from both ends of the post terminating at one end under the head of the bolt 74 and at the other end under the nut on that bolt. Suitable grommets (not shown) would be provided in the element 82 to accommodate the bolt and strengthen the connection.

The purpose of the safety element 82 is to continue to provide a mechanical link between the user and the pole in the unlikely event that the handle should snap or break in use. The element is accommodated as it passes along the side pieces 60, 62 in respective recesses 84, 86 defined by respective peripheral walls 88, 90 formed integrally with the moulded arm. The peripheral wall is raised above the level of the element 82 to protect it.

Figure 4:
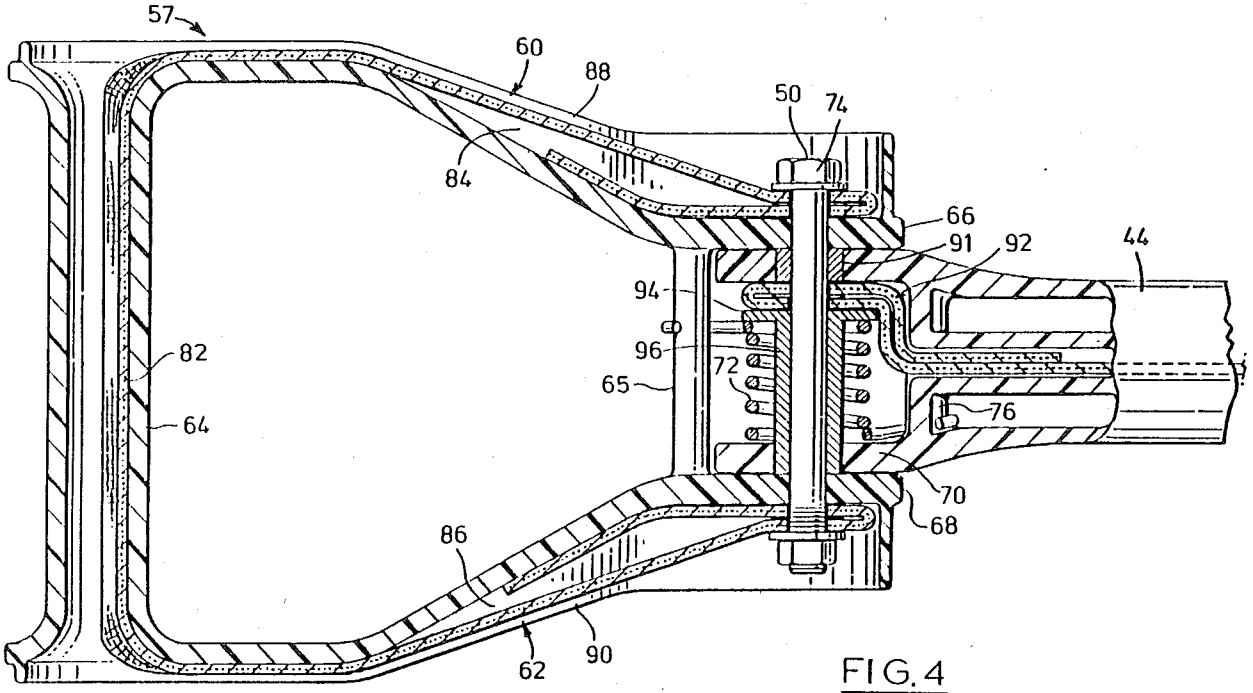
FIG. 4 is a sectional view on line 4—4 of FIG. 2, and drawn to a larger scale.

Turning now to FIG. 4 for a further explanation of the pivot joint 50, it will be seen that the bolt 74 is threaded only at its extreme end and fitted through a series of parts to act as an axle. The bolt extends firstly through the boss 66 in the side piece 60, then through a bushing 91 carried at one side of the forked end 70, then through an end part of a further safety element 92, which will be described later.

Element 92 sits between the bushing 91 and a flanged end 94 on a sleeve 96 which extends through the torsion spring 72 terminating in the other side of the forked end 70 and also acting as a bearing. Finally, the bolt passes through the boss 68 and the other end of the handle safety element 82. The tolerances are chosen so that the bolt is a push fit through the bosses 66, 68, and the bushing 91 and sleeve 96 are push fits in the forked end 70. The bolt defines a bearing surface so that when the handle rotates, sliding takes place between the bolt and the bushing and the sleeve.

One of the features of the pivot joint 50 is that apart from a mechanical connection permitting pivoting between the arm and the yoke, there is a mechanical continuity in the event that the moulded handle and yoke should break. It will be seen that the handle safety element 82 is attached at both of its ends to the bolt 74 and that the yoke safety element 92 is also attached to the bolt. Consequently, in the unlikely event that one of the parts would break, the climber will always have a mechanical connection (at the very minimum) by these elements to the pole.

Figure 5:
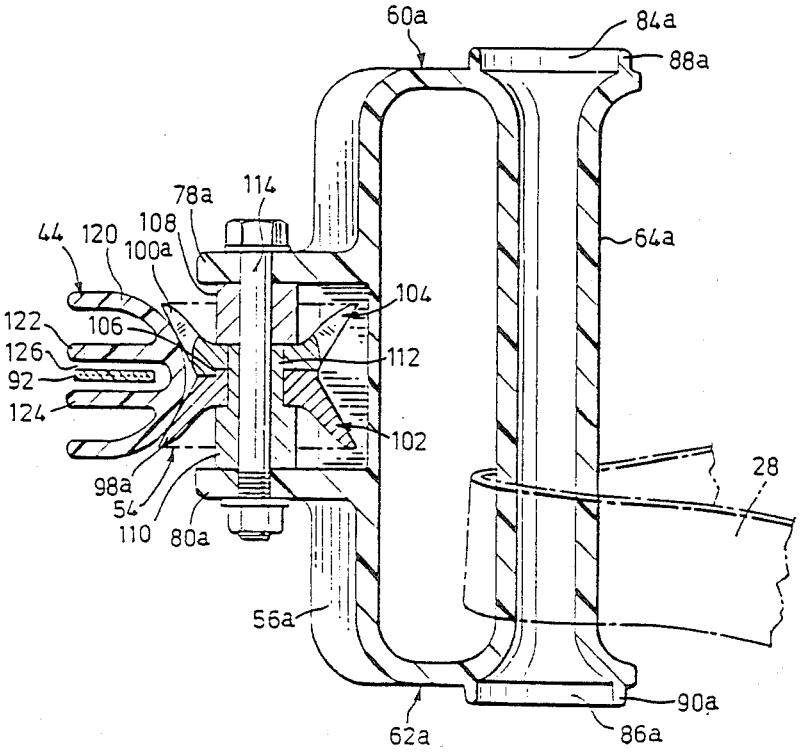
FIG. 5 is a sectional view on line 5—5 of FIG. 2, and drawn to a larger scale.

Reference is next made to FIG. 5 which is a sectional view of a portion of the arm 48 rather than the arm 46 shown in FIG. 3. Because of the similarity between the arms however, the attachment of the wheeled gaff will be described with reference to FIG. 5. Parts corresponding to those already described with reference to FIG. 3 will be given the same reference numeral with the suffix "a".

As best seen in perspective view FIG. 3, each of the wheeled gaffs 54, 56 has first and second rows of spikes 98, 100 which face in opposite directions. The spikes 98 face downwardly (as drawn) and would support the climber if the device is used in this position. However, in order to ensure that the device can be used in the inverted position, the spikes 100 face in the opposite direction. As a result the device is failsafe in the sense that the climber cannot put it on the pole in the wrong orientation.

In order to ensure that the spikes 98 have a maximum opportunity for engagement in the pole, each of the spikes 98 is spaced with reference to a vertical orientation between the spikes 100 and vice versa. Consequently there is less opportunity for the spikes 100 to interfere with the engagement of the spikes 98 because of the gap between the spikes 100 being in the same alignment with one of the spikes 98.

Turning now to FIG. 5, it will be seen that the section taken is through the spikes 98*a* and through the gap between spikes 100*a*. Effectively, the rotatable gaff 54 is in two parts, namely first part 102 and second part 104. Although these parts are similar with respect to the spikes they carry, they are arranged with an engagement pattern between them at 106 such that they lock and cannot be rotated relative to one another. In position, they are held in engagement by a sleeve 108 combining with a further sleeve 110 having a tubular end projection 112 proportioned in length such that it is in abutment with the sleeve 108 to provide sufficient axial clearance to permit rotation of the gaff on the tubular projection 112. A fitted bolt 114 passes through the sleeves and through the ribs 78*a*, 80*a* to hold the assembly in place.

FIG. 5 also shows part of strap 28 passing around the post 64*a*, and of course the strap will similarly pass around the post 64 (FIG. 3). There is sufficient space on the post 64*a* to allow the user to grip the post above the strap in a natural arrangement because the strap will tend to be below the hand due to its attachment at the waist.

Reference is next made to FIG. 1 to describe the yoke 44 more fully. As seen in FIG. 1, the generally V-shaped yoke 44 consists of two curved elongage parts 114, 116 which meet at an integral bend 118. Each of the parts 114, 116 is itself curved and is convex facing the pole 22. This convex shape tends to rigidify the parts against bending caused by the load applied to support the climber.

The cross-sectional shape of the parts 114, 116 and bend 118 of the yoke 44 is best seen in FIG. 5. Here it will be seen that the section consists of a generally C-shaped part 120 with its open side facing outwardly and reinforced by a pair of parallel ribs 122, 124 defining between them a central slot 126 containing and aligning the yoke safety element 92. The curved outer surface defined by this C-shaped part 120 nestles with the gaff 54 in the storage position shown to the right of FIG. 2 both to provide a compact structure when stored and also to act to some extent as a keeper for the gaff. Further, the arrangement minimizes the risk of personal injury caused by coming into contact with the spikes of the gaff wheel.

As previously mentioned the yoke 44 contains a safety element 92 described to some extent with reference to FIG. 4 where it meets the pivot joint. It also of course meets the pivot joint at its other end and in between these points passes through the slot 126 (shown in FIG. 5). There is therefore a mechanical continuity between the pivot points 50, 52 so that in the event that the moulded yoke 44 should break, the yoke safety element 92, in combination with the handles 46, 48, will continue to provide a mechanical link around the pole.

In use the fall arrest device would normally be stored with the arms in a position shown for the arm 48 in FIG. 2. The strap 28 normally used with the device and shown in FIG. 1 would be separated from the user's belt 26 at the snap fittings 32, 34. When the user wishes to climb a pole, first of all the pole has to be within a range of diameters suitable for the device. If the pole is too large, then the user will find the handles defined by the posts 64, 64*a* to be too wide apart. This of course can be compensated for by designing a bigger yoke to take larger poles.

Once the correct size of device has been matched to the pole to be climbed, the user will then place the device around the pole and then attach himself using the snap fittings 32, 34. With the device elevated to a comfortable height, the user will then use the leg gaffs 40, 42 to start climbing and as he goes up, he will move his weight so that he can lift the device above him. In the event that the gaffs 40, 42 should slip or break, then the user would tend to fall and his fall would be arrested by the device. Because of the alignment of the strap the resultant forces on the handles will act along lines of force extending outside the respective pivot points 50, 52. Consequently, the user's body causes turning moments to pull the arms 46, 48 into engagement with the pole causing the gaffs to dig into the pole and prevent a fall. The user would stay suspended in this position until he either re-engages the pole with the leg gaffs or possibly in an extreme case, is rescued from the pole. In any event, the forces created in the device by a slipping or falling climber would result in a more positive grip on the pole.

As the climber moves up the pole, he may wish to rotate around the pole rather than go higher. This can be done by moving the leg gaffs sideways and with a suitable transfer of body weight, the device will rotate around the pole while supporting the climber. This is because the smooth surface of the yoke presented to pole will have quite small resistence and the rotatable gaffs 54, 56 will rotate about their support axis while digging into the pole. As these gaffs rotate there may be a slight downward movement as one spike leaves the pole and another engages, but this will be minimal.

As the climber moves further up the pole, the diameter will probably reduce and the device, within limits, will accommodate this.

In the unlikely event that a faulty or damaged structure is used, then as previously described, the safety elements threaded entirely through the device will receive load from the climber and wrap around the pole to help to maintain the climber in an elevated position. The gaffs will probably continue to dig into the pole, but in the most extreme case where this does not happen, the climber would be left in effect with a rope attachment, the rope being formed by the safety elements.

The invention has been described with reference to a pole climbing or pole arrest device suitable for use on the most common of poles which is a wood pole. However, other types of poles are available and the device can be modified for use with these. A form of leg gaff is available for instance for climbing concrete poles and in combination with such gaffs, a fall arrest device according to the invention could be used. In place of the spiked gaffs 54, 56 (which are specific examples of engagement structures) a compliant rubber-faced roller is used having high friction characteristics. The engagement with the pole caused by the stress in the strap 28 is then sufficient to prevent downward sliding due to the friction between the rollers and the pole. Also, because of the high frictional properties of a concrete pole, the yoke is protected against wear by cladding the yoke with a sheathing of steel or other suitable wear-resistant material.

Such uses are envisaged for the invention, as well as others where climbing of this type is anticipated.

The embodiments of the invention in which an exclusive property or privilege is claimed are defined as follows:

1. A fall arrest device for use when climbing poles using moveable foot supports, the fall arrest device being operable by the climber's hands and supporting the climber by a waist belt, the device comprising:

a yoke for engagement with a pole on the side opposite the climber, the yoke having ends and a smooth surface for contacting the pole;

a pair of arms attached pivotally to the yoke for movement, one at each of the ends and extending generally towards the climber in use, the pivotal attachments being parallel to one another on first and second axes which are generally vertical when the device is in use on the pole, the arms having handles and strap attachment means for receiving a strap to connect the climber's waist belt to the device;

rotatable engagement structures attached about respective third and fourth axes of rotation, parallel to said first and second axes, to one of each of the arms adjacent the handles, and adapted to engage the pole to limit downward sliding motion and permit movement of the device around the pole; and said yoke and arms being proportioned for use on a pole such that when the climber leans outwardly the resultant forces exerted on the arms by the strap, through the strap attachment means, cause turning moments about said first and second axes to bring the arms inwardly towards the pole to force the engagement structures into contact with the pole.

2. A fall arrest device as claimed in claim 1 in which the engagement structures are rotatable gaffs carrying a plurality of spikes for engaging wood poles.

3. A fall arrest device as claimed in claim 2 in which each of the gaffs has spikes extending both upwardly and downwardly.

4. A fall arrest device as claimed in claim 3 in which the arms and the yoke further include respective safety elements extending through the arms and yoke to ensure mechanical continuity in the event of breakage of an arm or of the yoke.

5. A fall arrest device for use when climbing poles using moveable foot supports, the fall arrest device being operable by the climber's hands and supporting the climber by a waist belt, the device comprising:

a yoke for engagement with the pole on the side opposite the climber, the yoke having ends and a smooth surface for contacting the pole;

a pair of arms attached pivotally to the yoke for movement one at each of the ends and extending generally towards the climber in use, the pivotal attachments being parallel to one another on axes which are generally vertical when the device is in use on the pole, the arms each defining hollow posts defining a handle and strap attachment means for receiving strap to connect the climber's waist belt to the device;

engagement structures attached to one of each of the arms adjacent to the handles and adapted to engage the pole to limit downward sliding motion;

safety elements passing through the hollow posts and the yoke and meeting mechanically at said pivotal connections between the yoke and the arms to receive loading caused by accidental breakage of one of the arms and the yoke; and said yoke and arms being proportioned for use on a pole such that when the climber leans outwardly the resultant forces exerted on the arms by the strap, though the strap attachment means, cause turning moments about said axes to bring the arms inwardly towards the pole to force the engagement structures into contact with the pole.

6. A fall arrest device for use in climbing poles, the device comprising: a yoke; a pair or arms pivotally dependent from the yoke and having engagement structures for contact with the pole at opposite sides of the pole; the arms terminating remote from the yoke in handles which also receive a strap used by the climber to attach a waist belt to the device, the handles being hollow; and safety element means engaged through the handles and the yoke and continuous mechanically so that should any part of the yoke or arms break, the safety element forms a continuous link between the strap and around the pole.

7. A fall arrest device as claimed in claim 6 in which the handles are in the form of parallel hollow posts.

8. A fall arrest device as claimed in claim 6 in which the safety element means is of strips of webbing material.

9. A fall arrest device as claimed in claims 1, 5 or 6 in which the engagement structures are wheels of resilient high friction material for use when climbing concrete posts and the like.

10. A fall arrest device as claimed in claims 1, 5 or 6 in which the arms are biased to pivot relative to the yoke so that the engagement structures come into engagement with the yoke for storage.

11. A fall arrest device as claimed in claims 1, 5 or 6 in which the cross-section of the yoke is generally C-shaped with a smooth outer surface facing inwardly for contact with the pole.

* * * * *